US010322836B2

(12) United States Patent
Catlin et al.

(10) Patent No.: US 10,322,836 B2
(45) Date of Patent: Jun. 18, 2019

(54) BOTTLE INSERT PRY TOOL

(71) Applicant: My Oil Key LLC, Ogden, UT (US)

(72) Inventors: Diana Catlin, Ogden, UT (US); James B. Catlin, III, Ogden, UT (US)

( * ) Notice: Subject to any disclaimer, the term of this patent is extended or adjusted under 35 U.S.C. 154(b) by 299 days.

(21) Appl. No.: 15/290,935

(22) Filed: Oct. 11, 2016

(65) Prior Publication Data

US 2017/0029151 A1 Feb. 2, 2017

Related U.S. Application Data

(63) Continuation of application No. 15/174,725, filed on Jun. 6, 2016, now Pat. No. 9,487,318.

(60) Provisional application No. 62/171,236, filed on Jun. 5, 2015.

(51) Int. Cl.

| | |
|---|---|
| ***B25B 27/02*** | (2006.01) |
| ***B65B 61/20*** | (2006.01) |
| ***B65B 61/18*** | (2006.01) |
| ***B65B 7/28*** | (2006.01) |

(52) U.S. Cl.

CPC ..... *B65B 61/20* (2013.01); *B25B 27/02* (2013.01); *B65B 7/2821* (2013.01); *B65B 61/18* (2013.01)

(58) Field of Classification Search

CPC ..... B25B 13/18; B25B 13/32

See application file for complete search history.

(56) References Cited

U.S. PATENT DOCUMENTS

| | | | | |
|---|---|---|---|---|
| D116,179 | S | 8/1939 | Yates, Jr. | |
| D156,315 | S * | 12/1949 | Chuck | D8/18 |
| 3,517,714 | A | 6/1970 | Desbarats | |
| D306,124 | S | 2/1990 | Hoilien | |
| D311,667 | S | 10/1990 | Cholagh | |
| D361,024 | S * | 8/1995 | Chuck | D8/40 |
| D616,719 | S | 6/2010 | Moore | |
| D661,559 | S * | 6/2012 | O'Connell | D8/18 |
| D689,351 | S | 9/2013 | Webb, Jr. | |
| 8,607,668 | B1 * | 12/2013 | Frank | B67B 7/16 81/3.09 |
| 9,487,318 | B1 * | 11/2016 | Catlin | B25B 27/02 |
| 2006/0130613 | A1 | 6/2006 | Oleksy | |
| 2007/0089569 | A1 | 4/2007 | Hernandez, Jr. | |
| 2015/0266710 | A1 | 9/2015 | Camp | |
| 2017/0029151 | A1 * | 2/2017 | Catlin | B25B 27/02 |

OTHER PUBLICATIONS

Anso Knives, Website screenshot of Anso barber, also available at https://anso-of-denmark.com/collections/gear/products/barbar.

Gear Hungry, Website screenshot of Anso barber, also available at https://www.gearhungry.com/anso-barbar/.

* cited by examiner

*Primary Examiner* — Lee D Wilson

(74) *Attorney, Agent, or Firm* — Durham Jones & Pinegar; Chris Wight; Sarah Matthews

(57) ABSTRACT

The present invention relates to pry tools for removing the dispensing insert from a bottle. More specifically, the present invention relates to a lightweight, portable, multi-use hand tool capable of removing the vial-top dispensing inserts in common use for essential oils, perfumes, medicinal liquids, and other liquids. The pry tool can also be used to insert a dispensing insert (such as a rollerball, dropper, or aperture-reducer) into bottles of varying sizes.

18 Claims, 2 Drawing Sheets

BOTTLE INSERT PRY TOOL

BACKGROUND

State of the Art

The present invention relates to pry and press tools for removing the dispensing insert from a bottle. More specifically, the present invention relates to a lightweight, portable, multi-use hand tool capable of removing the vial-top dispensing inserts in common use for essential oils, perfumes, medicinal liquids, and other liquids. The pry and press tool can also be used to insert a dispensing insert (such as a rollerball, dropper, or aperture-reducer) into bottles of varying sizes.

Field of Art

Small bottles or containers, often made of glass or hard plastic, are commonly used to carry personal quantities of liquids such as perfumes or essential oils. These bottles or vials may be a variety of sizes and may have a variety of mouth or opening dimensions—10 ml elongate and threaded glass bottles, about 7 cm tall, are commonly used, but the bottles may be very small, with 0.5 ml of volume or even less. The mouth of the bottle (through which a liquid is inserted into or dispensed from the bottle) may range from approximately 2 cm to 0.5 cm. In order to allow a user to dispense only a few drops at a time, the bottles have an insert in the opening, such as an aperture reducer, droppers, caps, spigots, rollerballs, or cork-like inserts. The insert is typically made of a pliable material, such as plastic, which allows for a fluid tight fit, but which also makes it difficult to manually press on and remove the insert. An outer cap may then be screwed onto the bottle in order to prevent accidental dispensing of the liquid.

These cork-like inserts, however, must typically be removed in order to fill the bottle with fluid again. Moreover, the inserts may become worn or damaged, and must be replaced. Because the bottles and their corresponding inserts may be very small, when removing or replacing these inserts it can be difficult to apply the needed amount of force with the limited area available. Further, both the bottle and the insert may be very slippery, especially if the bottle was filled with an oil-based fluid.

Many people are forced to use knives, fingernails, counter edges, or other unwieldy and potentially dangerous tools to remove and re-secure these inserts. This may cause damage to the inserts, some of which may be quite expensive, or even personal injury. Some inserts, such as rollerballs (which dispense fluid in the same manner as the tip of a ball-point pen), cannot be pressed on directly, because the ball is often hollow and may collapse under excessive pressure. Other inserts such as aperture reducers (which contain a single small hole at the center, and otherwise seal tightly in the mouth of the bottle) are difficult to press into place with a finger. This is because the finger may cover the small hole, and as the insert is pressed into place, the air pressure inside the bottle increases. When pressure is released, liquid in the bottle may splash back, wasting or spilling it. Elderly users, especially those with arthritis, may not have the manual dexterity to remove the inserts at all.

Currently there is no tool available that can be used both to pry loose and/or to firmly press in, a removable bottle cap insert, spigot, rollerball, aperture reducer, or similar bottle fitment. Thus there is a need for a tool which not only performs these functions for a variety of varying bottle and insert sizes, but is also hand-held, and easily portable. It is further advantageous if the device offers a variety of gripping positions and fulcrums suitable for either right or left-handed, arthritic or unimpaired users. It is beneficial if the tool is made of a material which does not pit, deform, or alter due to long exposure to the types of fluids or oils commonly placed in small bottles or vials. Finally, it is advantageous if the tool is flat and lacks sharp exposed edges or points, so that it can be easily slipped into a pocket without snagging, or inserted between the pages of a book (for example, a perfume recipe book.)

SUMMARY OF THE INVENTION

The following summary of the present invention is not intended to describe each illustrated embodiment or every possible implementation of the invention, but rather to give illustrative examples of application of principles of the invention.

In some embodiments, the bottle cap pry and press tool includes a planar body with a first body side, a second body side, a body thickness, a body length, and a body width; the body has a rounded corner; a press opening; and a profile cutout; and the profile cutout includes a bevel.

In other embodiments, the bottle cap pry and press tool also includes a flange in the press opening. The flange may be thinner than the body, and may substantially surround the press opening.

In still other embodiments, the body of the bottle cap pry and press tool may further include a second press opening.

In some embodiments, the second press opening may have a second flange. In some embodiments, the flange of the second press opening may be located on an opposite side of the body than the flange of the first press opening.

In still other embodiments, the first and second press opening may be circular. The press openings may additionally be offset.

In still other embodiments, the bottle cap pry and press tool may include a lanyard opening.

In some embodiments, the length of the body may be greater than the width of the body in order to provide multiple fulcrums.

In other embodiments, the tool may further include a second profile cutout having a second bevel. In some embodiments, this second profile cutout may be located opposite the first. Alternately, the first and second profile cutouts may be located substantially adjacent to one another.

In still other embodiments, the bevels may taper at an angle, the angle being between about seven and twelve degrees.

In some embodiments, the diameter of the cutout may be greater than the diameter of the bevel.

In other embodiments having two press openings, one press opening may be larger than the other.

In some embodiments having two profile cutouts, the diameter of one cutout may be larger than the other.

In still other embodiments having two profile cutouts with two bevels, the bevels may differ—for example, one may be substantially more blunt than the other, or one may be a flat, shelf- or ledge-like projection.

A method of making a bottle cap pry and press tool may include selecting a flat sheet of material such as 6061 aluminum, nylon resin, and polyoxymethylene, forming a planar body from the flat sheet of material, forming a rounded corner on the planar body; forming a profile cutout on the at least one edge of the planar body; forming a profile cutout bevel substantially inside the profile cutout; and forming at least one press opening in the planar body.

In some embodiments, the method may further include forming a press flange around the press opening, and forming a lanyard opening.

Some methods of using the bottle insert pry tool may include the steps of selecting a planar tool having a semicircular profile cutout, the profile cutout having a beveled edge; inserting the beveled edge between a bottle insert and a bottle mouth; and pressing down on one end of the planar tool to lever the bottle insert out of the bottle mouth. In some aspects, methods of use may include inserting a new bottle insert loosely into the bottle mouth; fitting a press opening of the planar tool over the new bottle insert; applying pressure on the planar tool in order to press the new bottle insert into the bottle mouth. In some embodiments, a method of use may also include not covering an aperture of a bottle insert while the bottle insert is being pressed into the bottle.

These and other aspects of the present invention are realized in a bottle cap pry and press tool as shown and described in the following figures and related description. It will be appreciated that various embodiments of the invention may not include each aspect set forth above and aspects discussed above shall not be read into the claims unless specifically described therein.

BRIEF DESCRIPTION OF THE DRAWINGS

Various embodiments of the present disclosure are shown and described in reference to the numbered drawings.

Figure 1:
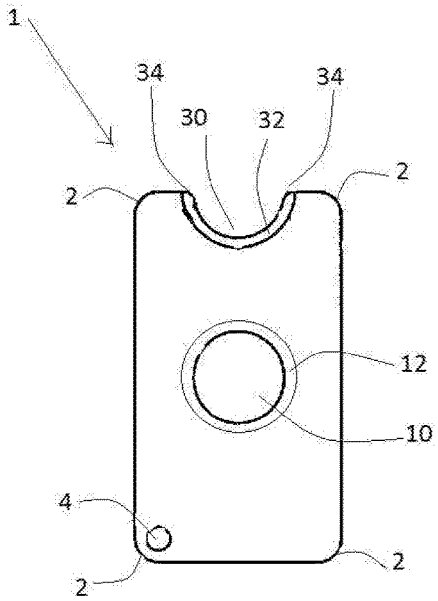
FIG. 1 shows a top view of one embodiment of a bottle cap pry and press.

It will be appreciated that the drawings are illustrative and not limiting of the scope of the invention which is defined by the appended claims. The embodiments shown accomplish various aspects and objects of the invention. It will be appreciated that it is not possible to clearly show each element and aspect of the present disclosure in a single figure, and as such, multiple figures are presented to separately illustrate the various details of different aspects of the invention in greater clarity. Similarly, not all configurations or embodiments described herein or covered by the appended claims will include all of the aspects of the present disclosure as discussed above.

DETAILED DESCRIPTION

Various aspects of the invention and accompanying drawings will now be discussed in reference to the numerals provided herein so as to enable one skilled in the art to practice the present invention. The skilled artisan will understand, however, that the methods described below can be practiced without employing these specific details, or that they can be used for purposes other than those described herein. Indeed, they can be modified and can be used in conjunction with products and techniques known to those of skill in the art in light of the present disclosure. The drawings and the descriptions thereof are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Reference in the specification to "one configuration," "one embodiment" "one aspect" or "a configuration," "an embodiment" or "an aspect" means that a particular feature, structure, or characteristic described in connection with the configuration may be included in at least one configuration and not that any particular configuration is required to have a particular feature, structure or characteristic described herein. The appearances of the phrase "in one configuration" or similar phrases in various places in the specification are not necessarily all referring to the same configuration, and may not necessarily limit the inclusion of a particular element of the invention to a single configuration, rather the element may be included in other or all configurations discussed herein. Thus it will be appreciated that the claims are not intended to be limited by the representative configurations shown herein. Rather, the various representative configurations are simply provided to help one of ordinary skill in the art to practice the inventive concepts claimed herein.

Furthermore, the described features, structures, or characteristics of embodiments of the present disclosure may be combined in any suitable manner in one or more embodiments. In the following description, numerous specific details may be provided, such as examples of products or manufacturing techniques that may be used, to provide a thorough understanding of embodiments of the invention. One skilled in the relevant art will recognize, however, that embodiments discussed in the disclosure may be practiced without one or more of the specific details, or with other methods, components, materials, and so forth. In other instances, well-known structures, materials, or operations may not be shown or described in detail to avoid obscuring aspects of the invention.

Before the present invention is disclosed and described in detail, it should be understood that the present invention is not limited to any particular structures, process steps, or materials discussed or disclosed herein. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect is required to be present apart from an express inclusion of that aspect in the claims.

It should also be noted that, as used in this specification and the appended claims, singular forms such as "a," "an," and "the" may include the plural unless the context clearly dictates otherwise. Thus, for example, reference to "a bracket" may include an embodiment having one or more of such brackets, and reference to "the target plate" may include reference to one or more of such target plates.

As used herein, the term "substantially" refers to the complete or nearly complete extent or degree of an action, characteristic, property, state, structure, item, or result to function as indicated. For example, an object that is "substantially" enclosed would mean that the object is either completely enclosed or nearly completely enclosed. The exact allowable degree of deviation from absolute completeness may in some cases depend on the specific context, such that 'a bevel surrounding nearly all of a cutout' would be substantially surrounded, even if the bevel included a slit or channel formed along a portion thereof. The use of "substantially" is equally applicable when used in a negative connotation to refer to the complete or near complete lack of an action, characteristic, property, state, structure, item, or result.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

The invention and accompanying drawings will now be discussed in reference to the numerals provided therein so as to enable one skilled in the art to practice the present invention. The drawings and descriptions are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Turning now to FIG. 1, there is shown a top view of one embodiment of a bottle cap pry and press tool, indicated generally at 1. The shape of the tool may be approximately rectangular, or may be fanciful—for example, shaped like an owl or bird, or other irregular object. In the embodiment shown in the figure, the tool 1 may measure approximately 5 cm by 3 cm, with a thickness of approximately 0.2 cm. It is advantageous in some embodiments if the tool 1 has varying dimensions (e.g. it is not a square or a round object) in order to offer the user the choice of several fulcrum lengths, as explained below. The corners 2 of the tool 1 may be substantially rounded, in order to make the tool more comfortable to grip. The tool 1 may further include a lanyard opening 4, which may be sized to accept a key ring, bookmark ribbon, or lanyard string.

It is advantageous if the tool 1 is formed of a durable material, for example, aluminum, heavy or stiff plastic, or sheet metal. It is also advantageous if the surface can be finished or colored. When used with bottles containing essential oils, the tool 1 may be made of materials which have been found not to corrode in the presence of essential oils. Extensive soak-testing has revealed that polyoxymethylene (e.g. Delrin® acetate) and nylon resin both perform well. Aluminum 6061 (a precipitation-hardened aluminum alloy containing magnesium and silicon) is durable in the presence of essential oils, resistant to scratches and bending, and maintains a particularly good finish. Aluminum 7075 can be used, but tends to scratch and will not maintain an attractive finish after long use with some essential oils.

The tool 1 may be shaped by any means known to one of skill in the art, such as punch, shear, laser cutting, casting, molding or injection molding, etc.

The tool 1 may further include at least one press opening 10. The press opening 10 may be sized to fit over the insert of a standard perfume vial insert, while being smaller than the lip or collar of the insert, which prevents the insert from being pushed entirely into the vial. Thus, the press opening 10 is large enough to surround the spigot, rollerball, or other cap feature, while securely engaging the lip or collar of the insert to allow for the transfer of force from the larger surface area of the tool 1 to the smaller lip of the cap insert (see FIG. 4.) When installing a bottle or vial insert, such as a rollerball or aperture reducer, into the mouth of a bottle, the insert may be fitted loosely into the mouth of the bottle. Then, the press opening 10 can be fit over the insert, and then user can apply pressure to the tool 1 to press the insert into the bottle (not shown.) Because the press opening 10 is large enough to fit around the cap insert, there is no danger of crushing the cap insert (a particular hazard with rollerball cap inserts), or of increasing the air pressure within the bottle (which may cause spatters or, in some cases, even broken bottles.)

Several press openings 10 may be included in various embodiments of the tool 1. In such embodiments, the press openings 10 may be of varying sizes, in order to fit varying sizes of bottle mouth inserts. On one or both sides of the tool 1, the bottle press opening 10 may include a flange 12. The flange 12 may be a ledge-shaped portion of thinner metal, or may be a stamped depression on the body of the tool 1. One advantage of the flange 12 is that it engages the lip of a bottle insert (not shown) and provides the user with feedback regarding secure placement over the rim of the bottle insert (see FIG. 4), so that the bottle press opening 10 is located directly over any aperture in the bottle cap insert. In this configuration, air from the bottle can escape when the bottle cap insert is pressed into the bottle.

The tool 1 may further include at least one profile cutout 30. The profile cutout may be located either on the narrow end of the tool 1, or the wide side, or both. The profile cutout 30 may further include a shaped bevel or a ledge or rim 32. In use, the shaped bevel 32 is pried in between the lip of a bottle cap insert and the mouth of a bottle. The opposing end of the tool 1 can then be pressed downwardly, or the tool 1 can be rocked from side to side, thus levering the bottle cap insert out of the mouth of the bottle. In the pictured embodiment, the placement of the profile cutout 30 at the narrow end enables users to use a longer fulcrum to lever the bottle cap insert out of the mouth of the bottle.

One advantage of the pictured embodiment is that users with reduced manual dexterity, such as those with arthritis, can grip the tool 1 more easily between fingertips and thumbtip during use, which is often an easier hand position to use. Users with normal dexterity frequently prefer a profile cutout 30 which is located along the longer edge of the tool 1—the fulcrum is then shorter, but the user can grip the tool 1 between fingertips and the base of the thumb for finer control. Thus in some embodiments, a profile cutout 30 is provided at both a long edge and a short edge of the tool 1.

In some embodiments in which two or more cutouts 30 are provided, the cutouts may vary in size, in order to better fit bottle cap inserts of varying sizes.

The shaped bevel 32 may be a ledge-like projection, or may be tapered or wedge-shaped so that the leading edge is narrower than the base. When prying the bottle mouth inserts out of very small bottles, it is advantageous if the bevel 32 is tapered or wedge-shaped, in order to fit more exactly between the lip of the bottle mouth insert and the rim of the bottle (see FIG. 2). The counterbore angle of the bevel in tapered embodiments may be between approximately 5 degrees and 12 degrees. In some embodiments in which the tool 1 is formed from a particularly durable substance such as aluminum, a bevel angle between about 7-9 degrees may be advantageous.

In some embodiments, the bevel corners 34 may be rounded or angled, to reduce any sharp projections around the edge of the tool 1.

In the pictured embodiment, the bevel or ledge 32 is cut down or recessed from one surface of the tool 1.

Figure 2:
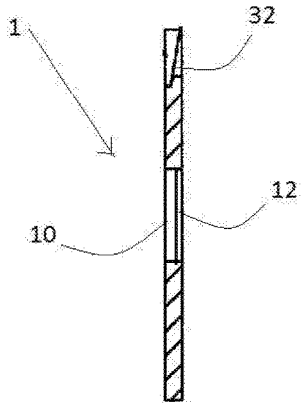
FIG. 2 shows a cut-away side view of a bottle cap pry and press tool, including the bevel angle.

Turning now to FIG. 2, there is shown a cutaway side view of the bottle cap pry and press tool 1 embodiment of FIG. 1 including the press opening 10 and press flange 12, as well as a cross-section showing tapering of the shaped bevel 32 in the profile cutout (not labeled). In the present embodiment, the shaped bevel 32 has a counterbore angle of approximately eight degrees. This tapering of the bevel 32 may be formed by, for example, a ⅝" counterbore or end mill drilled into substantially the full curvature of the profile cutout 30 to a depth of approximately 0.2 cm.

One advantage of this relatively sharp angle is that the leading edge of the bevel 32 is sharper, and may be more effective when prying very small bottle cap inserts out of very small bottles. Where a larger bottle cap insert must be pried out, however, a larger counterbore angle may be preferred for increased durability. In order to match the design of other bottle cap inserts, other shapes of bevel 32 may be advantageous (e.g. as in FIGS. 6, 7.)

Figure 3:
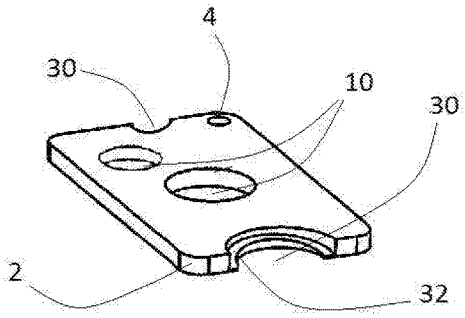
FIG. 3 shows a perspective view of one embodiment of a bottle cap pry and press.

Turning now to FIG. 3, there is shown a perspective view of an embodiment of a bottle cap pry and press tool having two press openings 10, and two opposing profile cutouts 30. In the present embodiment, the press openings 10 and profile cutouts 30 are sized to accommodate varying common sizes of bottle cap inserts. It will be appreciated that the press openings 10 need not be inline, but may rather be staggered along the length of the tool in order to fit more sizes of press openings 10 onto the tool.

Figure 4:
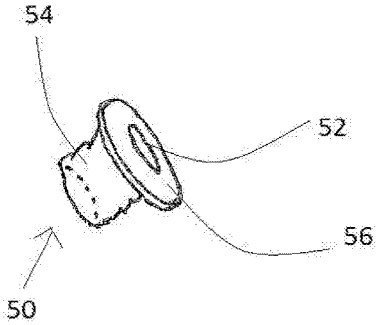
FIG. 4 shows a view of an aperture reducer commonly inserted into a small glass bottle.

FIG. 4 shows one example of a common type of bottle cap insert, indicated generally at 50. Such devices are commonly formed of rubber or plastic, depending on the application. The pictured type of bottle cap insert 50 is an aperture reducer, or narrowing insert, which allows liquid inside a bottle to be dispensed a drop at a time through a narrowed aperture 52. The bottle neck portion 54 fits tightly inside the mouth and neck of an appropriately-sized bottle. The small aperture 52 is surrounded by a lip 56, which is sized to be too large to fit through the mouth of the intended bottle. For example, inserts intended to fit very small bottles may have a bottle neck portion 54 approximately 0.7 cm in diameter, and a lip or collar 56 approximately 1.0 cm in diameter.

Referring back to FIG. 3, the bottle cap pry and press tool can be used to remove the bottle insert of FIG. 4 by wedging the bevel (32 of FIG. 3) under the lip (56 of FIG. 4) and prying upwards. Alternately, the bottle cap pry and press tool can be used to insert the bottle cap insert (50 of FIG. 4) into a bottle, as a press opening (10 of FIG. 3) may be selected of the appropriate size to engage the lip (56 of FIG. 4) without obscuring the aperture (52 of FIG. 4.) This feature ensures that air pressure does not build up within the bottle (not shown) as the bottle cap insert (50 of FIG. 4) is inserted.

It will be appreciated that the appropriate size of press opening 10 (FIG. 3) may also be used with other types and sizes of bottle cap insert, such as rollerballs, stoppers, etc.

Figure 5:
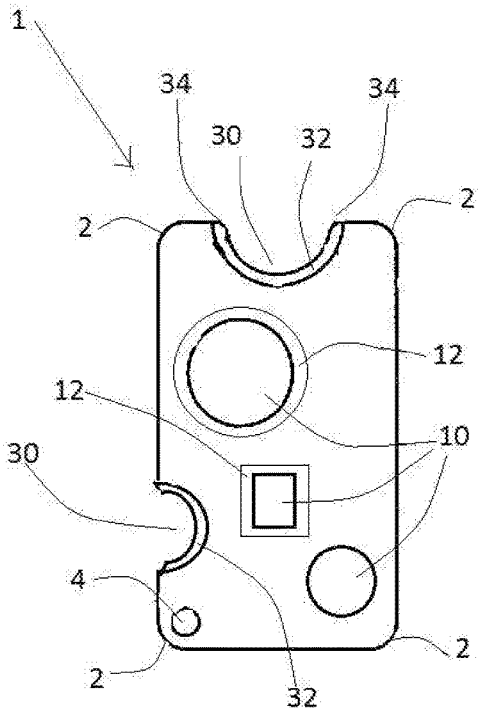
FIG. 5 shows a top view of one embodiment of a bottle cap pry and press, including opposing counterbore bevels and a press flange.

In FIG. 5 there is shown a top view of an alternate embodiment of a bottle cap pry and press tool, indicated generally at 1. In the present embodiment, one profile cutout 30 is provided at a short end of the tool (allowing for a longer fulcrum and easier grip for e.g. arthritic individuals.) An additional profile cutout 30 is provided on the long edge of the tool 1 (allowing for finer control and an alternate gripping position.) As in the present embodiment, the two profile cutouts 30 may be sized differently to accommodate differing sizes and types of bottle cap inserts.

FIG. 5 further shows a selection of varying press openings 10, of appropriate size and shape to fit common variants of bottle mouth inserts. Any or all of the press openings 10 may include a press flange 12 on either side of the tool.

Figure 6:
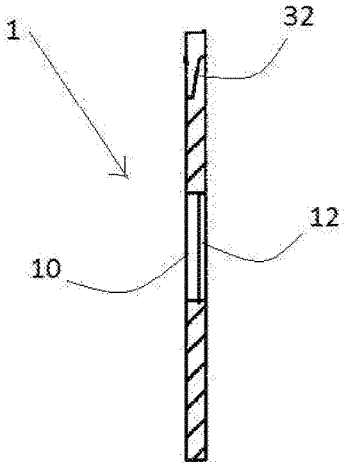
FIG. 6 shows one embodiment of a counterbore bevel.

Turning now to FIG. 6, there is shown a cut-away view of an alternate embodiment of a shaped bevel 32, in which the bevel 32 tapers steadily towards the blunted leading edge or tip.

Figure 7:
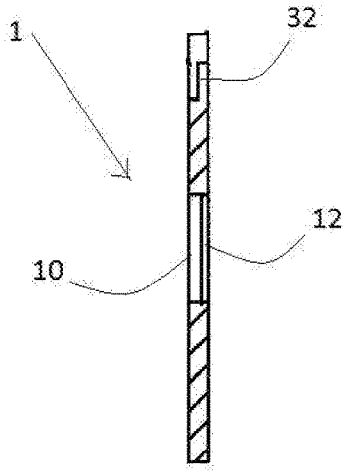
FIG. 7 shows a second embodiment of a counterbore bevel.

Likewise in FIG. 7, there is shown a cut-away view of an alternate embodiment of a shaped bevel 32, in which the bevel 32 is a blunt ledge-like projection. Such embodiments are less suitable for removing the inserts from very small bottles, however the wear on the bevel 32 is reduced.

Thus there is disclosed a bottle cap pry and press tool and methods of making and using the same. It will be appreciated that numerous modifications may be made without departing from the scope and spirit of this disclosure. The appended claims are intended to cover such modifications.

What is claimed is:

1. A bottle insert pry tool, comprising:

a planar body having a body thickness;

a semi-circular profile cutout in a side of the planar body, wherein the profile cutout has a first edge comprising a flange having a thickness less than the body thickness; and further comprising a press opening configured to press a bottle insert into the opening of a bottle.

2. A bottle insert pry tool comprising:

a planar body having a body thickness;

a first press opening configured to press a bottle insert into the opening of a bottle;

a semi-circular profile cutout in a side of the planar body, wherein the profile cutout has a first edge comprising a flange having a thickness less than the body thickness, the press opening further comprising a flange.

3. The bottle insert pry tool of claim 2, the flange having a flange thickness, the flange thickness being less than the body thickness.

4. The bottle insert pry tool of claim 3, wherein the flange substantially surrounds the first press opening.

5. The bottle insert pry tool of claim 4, further comprising a second press opening.

6. The bottle insert pry tool of claim 5, wherein the second press opening further comprises a second flange.

7. The bottle insert pry tool of claim 6, wherein the flange of the first press opening is on a first body side, and wherein the second flange of the second press opening is on a second body side.

8. The bottle insert pry tool of claim 7, wherein the first press opening and the second press opening are circular.

9. A bottle insert pry tool, comprising:

a planar body having a body thickness;

a semi-circular profile cutout in a side of the planar body, wherein the profile cutout has a first edge comprising a flange having a thickness less than the body thickness, further comprising a second profile cutout having a second edge, the second edge having a second edge thickness less than the body thickness.

10. The bottle insert pry and press tool of claim 9, wherein the body has a body length and a body width, the body length being greater than the body width.

11. The bottle insert pry tool of claim 9, wherein the profile cutout is located adjacent the second profile cutout.

12. The bottle insert pry tool of claim 9, wherein the first edge is beveled and tapers at a beveled angle; and the second edge is beveled and tapers at a bevled angle; the beveled angle being between about 5 degrees and about 12 degrees.

13. A bottle insert pry tool, comprising:

a planar body having a body thickness;

a semi-circular profile cutout in a side of the planar body, wherein the profile cutout has an edge comprising a flange having a thickness less than the body thickness, wherein the semi-circular profile cutout has a cutout diameter; and the edge is flat and has an edge diameter which is less than the cutout diameter; and the edge meets the planar body at a right angle.

14. A bottle insert pry tool comprising:

a planar body having a body thickness;

a semi-circular profile cutout in a side of the planar body, wherein the profile cutout has an edge comprising a flange having a thickness less than the body thickness, the semi-circular profile cutout has a cutout diameter; and the edge has an edge diameter which is less than the cutout diameter; and the edge is beveled and meets the planar body at an angle between about 5 degrees and about 12 degrees.

15. A method of using bottle insert pry tool comprising the steps of:

selecting a planar tool having a semi-circular profile cutout, the profile cutout having a beveled edge; and inserting the beveled edge between a bottle insert and a bottle mouth; pressing down on one end of the planar tool to lever the bottle insert out of the bottle mouth.

16. The method of using bottle insert pry tool of claim 15, further comprising the steps of:

inserting a new bottle insert loosely into the bottle mouth;

fitting a press opening of the planar tool over the new bottle insert, wherein the press opening is configured to fit over the new bottle insert;

applying pressure on the planar tool in order to press the new bottle insert into the bottle mouth.

17. The method of using bottle insert pry tool of claim 16, wherein the new bottle insert further comprises an aperture, the step of applying pressure on the planar tool further not covering the aperture of the new bottle insert.

18. A method of forming a bottle insert pry tool comprising the steps of:

forming a planar body;

forming a semi-circular profile gap on the at least one edge of the planar body;

forming a profile gap beveled edge substantially inside the profile gap;

forming a press opening;

forming a press flange around the press opening; and forming a lanyard opening.

* * * * *